United States Patent [19]

Sanchez

[11] Patent Number: 5,042,270

[45] Date of Patent: Aug. 27, 1991

[54] EVAPORATIVE COOLER WITH INCREASED PAD AREA

[76] Inventor: Marco A. Sanchez, 2926 W. Paseo De Las Aves, Tucson, Ariz. 85746

[21] Appl. No.: 615,503

[22] Filed: Nov. 19, 1990

[51] Int. Cl.[5] ..... F28D 5/00

[52] U.S. Cl. ..... 62/314; 62/304; 261/29

[58] Field of Search ..... 62/304, 305, 314, 311; 261/29, DIG. 11, 106, 107

[56] References Cited

U.S. PATENT DOCUMENTS 4,612,778 9/1986 Medrano ..... 62/304

4,819,448 4/1989 Campbell ..... 62/304

*Primary Examiner*—Albert J. Makay

*Assistant Examiner*—John Sollecito

*Attorney, Agent, or Firm*—J. Michael McClanahan

[57] ABSTRACT

An evaporative cooler is disclosed wherein at the four corners of the usual cube shaped cooler structure is added four outwardly protruding projections, each of the projections having louver openings on both its sides, as well as on the four sides of the cooler, with watered pads immediately behind in order to substantially increase the wetted pad area through which air flows into the evaporative cooler. In addition to the usual interiorly contained blower and water pump mechanisms in the cooler, a pad holding structure is disclosed to accommodate a single pad for each of the angled side members of the evaporative cooler, the structure including in addition to the side member a plurality of connected wire screens which attach to the side member at its edges, the wire screens and the side member compressibly encompassing a single pad over the whole side.

18 Claims, 2 Drawing Sheets

EVAPORATIVE COOLER WITH INCREASED PAD AREA

BACKGROUND OF THE INVENTION

1. Field of the Invention

The field of the invention is evaporative coolers and improvements to evaporative coolers.

2. Description of the Related Art

In areas of the United States Southwest which are hot and dry, the evaporative cooler is popular and works very well to cool the temperature of air for use in home and business space cooling. Evaporative coolers function by drawing air across water soaked pads and in the process, drop the temperature of the resulting air/water vapor mixture 10 to 15 degrees. They have been developed to a very high degree in the Southwest since they are much less expensive to purchase and to operate when compared with conventional space air conditioners.

In general, an evaporative cooler consists of a substantially cube shaped structure usually about 3 feet to 4 feet on each side with a squirrel cage type blower and motor interiorly to the structure. Each of the three or four sides (depending upon whether the evaporative cooler is a side-draft or down-draft model) have louver type openings through which pass outside air. Immediately adjacent to the louver openings, and inside the evaporative cooler, are pads, generally made from wood which has been processed to resemble straw. In many cases the pads material is called excelsior. These wood fibers are bundled into planar type pads of an inch or so in thickness and placed into the cooler against the single panel sides next to the louvered openings. At the top of each of the panels which make up the sides of the coolers is situated a water trough which receives water from a multi-legged spider, the spider having a plurality of pipes or tubes converging to a centrally located distributing manifold in the top of the cooler. Openings in the troughs allow water to drip onto the pads to percolate therethrough. Air drawn through the pads evaporate the water and in doing so, cools the resultant air/-water vapor mixture. The bottom of the evaporative cooler is used as a sump to gather the water percolating through the pads which is not evaporated. A recirculation pump returns the water from the bottom of the cooler to the distributing manifold of the spider.

In the interior of the evaporative cooler is the means by which air is pulled into the evaporative cooler through each of the louvered sides and the means to forcibly eject the air out of the evaporative cooler. This usually comprises a squirrel cage type blower situated interiorly to a blower housing, the housing having openings proximate each end of the squirrel cage blower axle bearings for air intake into the housing. Air taken into the blower housing is outputted through a conduit or duct connecting with the housing. A motor which rests on the outside of the blower housing has a pulley which connects with a belt to another pulley attached to the squirrel cage blower axle.

Evaporative coolers divide into two main groups, a down-draft type and a side-draft type. In the down-draft evaporative cooler, the conduit or duct directing air out of the cooler from the blower housing is downward (when the cooler is setting upright) and blows the air downward out of the cooler. In the down-draft type cooler, all four vertical sides of the cooler cube have louvered openings and have pads receiving water proximate the louvers. In the side-draft evaporative coolers, the conduit or duct from the blower cage housing exits one of the four vertical sides of the cooler (when the cooler is upright). In this type of cooler, only three sides of the four vertical sides have louvered openings and water receiving pads behind them.

Obviously, the down-draft type evaporative cooler for a same size cube construction provides more area exposed to the surrounding environment through which air may pass in its movement to the interior of the cooler to be blown out through the exit conduit or duct. This provides for increased efficiency of the cooler in that, by allowing more air to pass and thus to evaporate more water, a greater volume of the resultant air/water vapor mixture is achieved. On the surface then, it is readily apparent that, absent other factors, the down-draft evaporative cooler may be up to ⅓ more efficient than the 3 sided side-draft evaporative cooler. Increased efficiency will also show up in power consumption by the electrical motor since the motor and blower will have more air available to it through the increased louver openings and not have to work as hard for the air as in the side-draft model. Nevertheless, considerations external to the evaporative cooler usually determines which cooler will be used, primarily the home construction.

Thus it is readily apparent that for the same general sized cube evaporative cooler, increased louver and pad area available for allowing passage of outside air into the interior of the evaporative cooler results in a more efficient and better operating evaporative cooler, one that draws less electrical power to the electrical motor and which effectively cools a larger volume of air per unit time.

Thus it is readily apparent that if the louver opening and pad area of a standard evaporative cooler shall be increased, a resultant efficiency in evaporative cooler results.

It is therefore also obvious that for designs for evaporative coolers including increased louver openings and pad area, the efficiency of the evaporative cooler is enhanced.

SUMMARY OF THE INVENTION

The embodiment of the invention described consists of an evaporative cooler with increased louver openings and pads behind those openings whereby the area available to pass outside air interiorly to the cooler is substantially increased resulting in more efficient evaporative cooler operation requiring less electrical power to the motor interiorly and increased water evaporation and resultant air/water vapor mixture volume per unit time as well as the air/water vapor mixture having a temperature reduced over that of the surrounding environment air.

More particularly, the subject invention modifies the conventional cubed shaped evaporative cooler by placing at each of the four corners of the four vertical sides outwardly protruding projections, these projections providing additional louver openings with water receiving pads immediately behind them. Each of these projections are sufficiently wide that there is ample room to secure each pad behind the louver openings of each side as well as room between the pads to funnel the air passing through each pad to the contained blower housing.

Such a construction is possible by constructing each somewhat inwardly curved side (although each side is made of three straight panels), each of the two angled panels and the central front panel attaching as a single unit to the cooler frame with sheet metal screws or by other methods well known in the cooler art, one of these methods being where the bottom edge of the side resides inside the outer surrounding lip of the bottom pan of the cooler. The frame of the evaporative cooler comprises a minimum of the ends of each of the four projections, which are flat sided, together with the bottom pan and the top cover. The bottom pan is fixedly attached to each of the upright ends of the projections with rivets and the top cover may be fixedly attached at the top of the projections' ends or the top cover may be removable as desired. If the top is removable, when it is in place resting upon the exterior ends of the upright projections, it may be attached there by means of its downward lip overlapping the tops of the projections. A sheet metal screw will affix these two elements together.

Since each of the four sides are removable in the preferred embodiment, a wire screen structure especially constructed to accommodate the screen is detailed, the wire screen overlapping the pad material to secure the pad in place. The two panels on opposite sides of the front panel return to the rear at their far side in a cupped-like manner and attached to this cupped portion are protruding tabs with a finger hook. This finger hook engages an outside wire of the wire screens so that, when the three panels of the side, the water receiving pad, and wire screen assembly are all hooked together, the pad is firmly held next to the louvered openings and the pad's resistance to crushing provides the means to hold the ends of the screens against the hooked fingers of the protruding tabs attached to the cupped portion. Attached to each cooler side along each of the three flat panels at the vertical top of each panel are a plurality of water receiving troughs wherein openings in each of the troughs allow the water received to drip onto the pads immediately below for percolation through the pads to the bottom pan.

Interiorly to the evaporative cooler is the conventional cooler parts, namely the squirrel cage type blower and blower housing, the electrical motor connecting by belt to the squirrel cage blower pulley, the electrical water pump recirculating water from the lower water collecting sump or bottom pan to the top centrally located spider manifold that distributes water to the troughs through a multi-legged spider, and the float actuated valve which maintains the water level in the bottom of the cooler.

Air taken in the blower housing through openings on opposite sides of the squirrel cage blower proximate the blower bearings is pushed out a conduit or duct formed in the blower housing. In the down-draft model of the invention, all four sides are identical and air is blown vertically down and out of the cooler through an opening (or duct) in the bottom pan.

In the side-draft model of the invention, three sides of the four sided evaporative cooler are identical and have the louvered openings with pads immediately behind and the fourth side receives the conduit or duct from the interior blower housing in order that air brought into the evaporative cooler is blown horizontally out that side of the cooler.

Accordingly, it is an object of the subject invention to provide an evaporative cooler with increased louver opening and pad area to increase the efficiency of the evaporative cooler.

It is another object of the subject invention to modify the conventional cubed shaped cooler construction to provide projections at each of the four vertical corners, these projections providing additional louver opening area and pads immediately behind the openings for increased air flow and resulting increased cooler efficiency.

It is still a further object of the subject invention to provide a unique manner of securing the pads to each of the louvered sides of the evaporative cooler by wire type screen assemblies.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
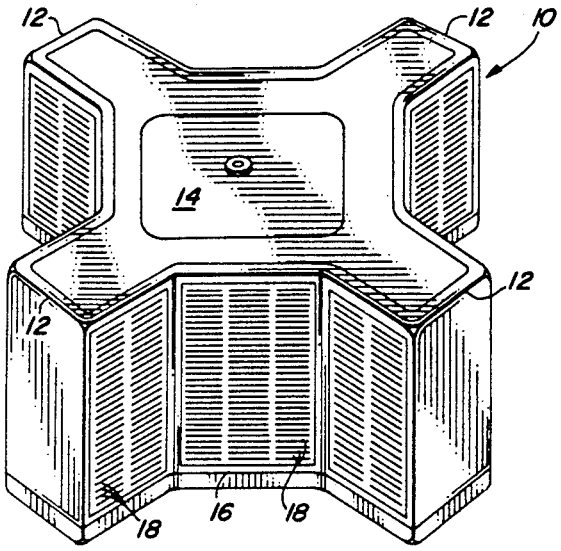
FIG. 1 is a perspective view of the subject inventive evaporative cooler with increased pad area.

Referring now to FIG. 1, a perspective view of the subject inventive evaporative cooler 10 incorporating the features of increased pad area through which outside air is drawn into the cooler is shown. It's increased pad area is obtained by four outwardly protruding cooler projections 12, one added at each of the four corners of the usual cube shaped structure. With the increased pad area upon which air may be drawn into the cooler, the cooler becomes more efficient in that the electrical power to operate the lower motor has been reduced since there is less restriction to the free flow of air. In addition, since air need not flow by each pad with the velocity in the subject invention as would be present in a usual four sided evaporative cooler, additional water will be taken into the air as water vapor, also increasing the efficiency of the cooler air/water vapor mixture output.

Seen in FIG. 1 is top cover 14 of the cooler which may be a permanent part of the structure, or the top cover may be removable, whichever is desired. Along each of the four sides 16 are the plurality of louver openings 18 through which air enters the evaporative cooler from the outside. As can be seen from FIG. 1, each of the four sides 16 of evaporative cooler 10 take on a somewhat arcuate or curved shape in appearance although all panels (three panels to each side) are straight and, for the down draft evaporative cooler all four sides will be identical. In the side draft cooler, one side is devoted to receiving the conduit through which air taken through the louvers is passed out of the cooler by the internal blower, and three sides are identical to side 16 shown in FIG. 1.

In most installations, the evaporative cooler shown in FIG. 1 will reside upon the top of the roof of a house, generally either sitting upon a four-footed frame structure holding the bottom of the evaporative cooler or, upon a square or rectangular shaped walled parapet engaging the bottom of the cooler. If the roof is pitched, the four legs of the cooler holding frame must be of a length to accommodate the pitch, and on the parapet construction, one wall will have a different height than the other with the two remaining walls tapered. The reason that the legs and the parapet must compensate for the pitch of the roof is because the cooler must reside horizontally level since it contains a pool of water in its bottom pan.

Figure 2:
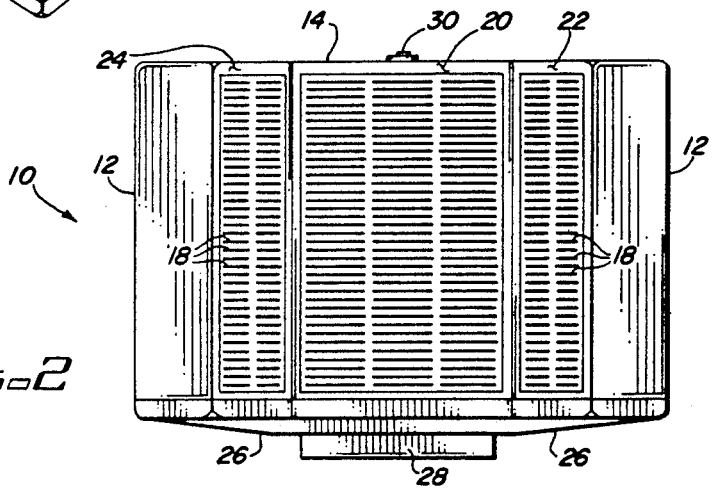
FIG. 2 is a front elevational view of the subject invention.

FIG. 2 is a front elevation view of the subject invention showing in more detail one of the four identical sides of a down-draft cooler or one of the three sides of a side-draft cooler. Here each side is made up of one formed member which is affixed to a portion of the frame interior to the cooler, each side member having three panels, each panel having a plurality of columns of louver openings situated in it. More specifically, centrally situated in FIG. 2 is front panel 20 having three columns of louvers. On either side of front panel 20 is right panel 22 and left panel 24, each of these panels being flat, but at an obtuse angle to the front or center panel, and each right and left panels having two columns of louver openings. The whole side with its center, right and left panels is affixed to the cooler frame by sheet metal screws or by other known techniques popular in the evaporative cooler art. One technique is to secure the bottom of the side member just inside the curved up edge of the bottom pan and place latches on opposites sides near the top of the side member. Seen also in FIG. 2 is top cover 14, bottom pan 26, and down-draft conduit or duct 28. It is intended in the preferred embodiment that each of the top and the bottom members of evaporative cooler 10 will be single pieces of material as is each side member. Lastly, shown at the very top of FIG. 2 is the water spider manifold holding mechanism 30 which, as will be discussed in connection with FIG. 4, secures the water spider manifold which distributes water to the various troughs overlying each of the pads.

Figure 3:
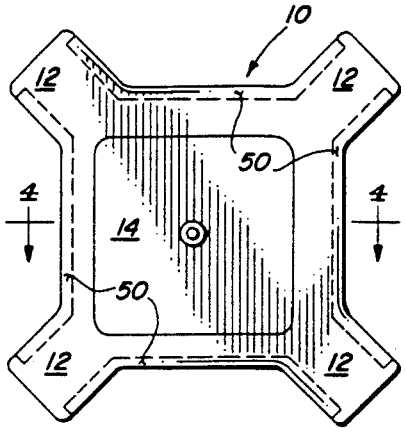
FIG. 3 is a top view of the subject invention with a sectional line taken across the invention.

FIG. 3 is a top view of the subject inventive evaporative cooler 10 showing each of the cooler projections 12 emanating from the four corners of the basic cube forming the cooler structure, and top cover 14. Outline of the pads 50 situated interiorly to the cooler are also shown. As seen in FIG. 3, sectional line 4—4 runs through the central portion of the cooler and the view seen at that point is shown in FIG. 4.

Figure 4:
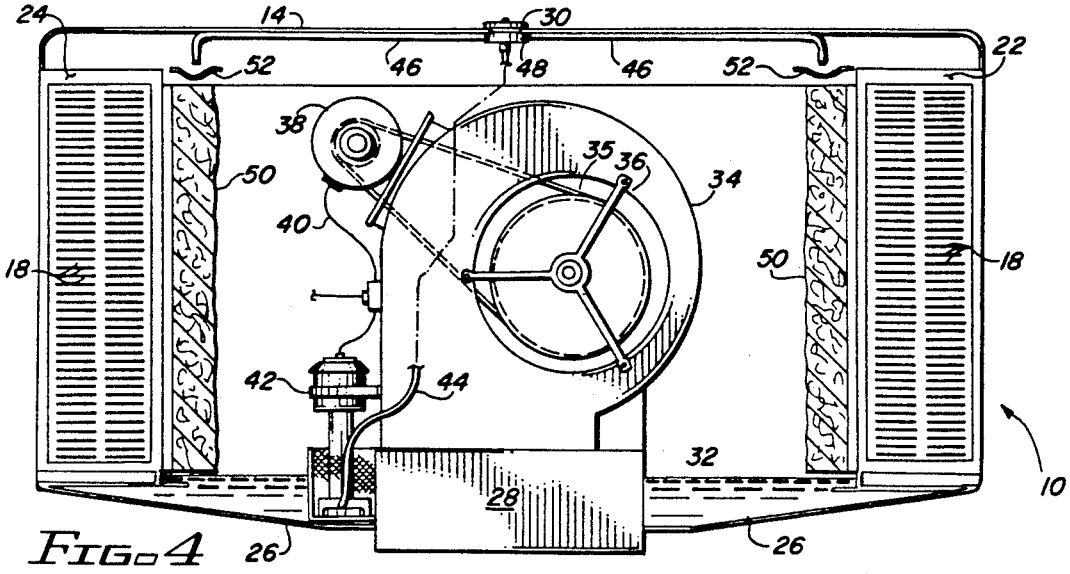
FIG. 4 is a sectional view of the subject inventive taken across the sectional line of FIG. 3.

Referring now to FIG. 4, the interior details of the subject invention are shown, as well as one each of the right and left panels which are outside the cooler. Interiorly to evaporative cooler 10 is firstly seen the water 32 in the bottom pan 26 of evaporative cooler 10, the water level maintained by a float valve mechanism (not shown). Interiorly at the center of the body of water residing in the bottom of cooler 10 is the blower assembly consisting of blower housing 34 which in itself comprises a metal housing around a squirrel cage rotor 36, the rotor being driven by motor 38. Electrical power is supplied to motor 38 by means of electrical wires 40. Also shown in FIG. 4 is the water pump 42 which recirculates the water held in the bottom of the cooler through tube 44 to a distribution point or manifold 48 at the center top of the cooler for distribution along each of spider legs 46. The water spider manifold holding mechanism 30 is shown attaching to top cover 14 of the invention, it being the securing means for holding each of the spider legs 46 and their central distribution manifold 48.

Additionally seen in the sectional view detailed in FIG. 4 are the evaporative cooler pads 50 through which water percolates, the water being directed to it from spiders 46 running into lengthwise troughs 52. Troughs 52 cover the length of the tops of each of the pads and have a plurality of openings therethrough so that the water deposited in the troughs through the spider legs 46 will distribute itself along the trough and drip onto the pads. It is noted that in FIG. 4, the pad extends a small distance below the water level. In the invention, because of the unique shape of the exterior portions of the device, specialized wire racks have been constructed within which are held each of the pads 50 in order that one continuous pad may be utilized for each of the four sides of the down draft cooler shown in FIG. 1. Lastly, down draft conduit or duct 28 is shown attached to the lower portion of blower housing 34, conduit or duct 28 providing the outlet for air forced out of the cooler by the rotating squirrel cage rotor 36. Air enters the blower housing 34 at opening 35 formed in the side of blower housing 34.

Figure 5:
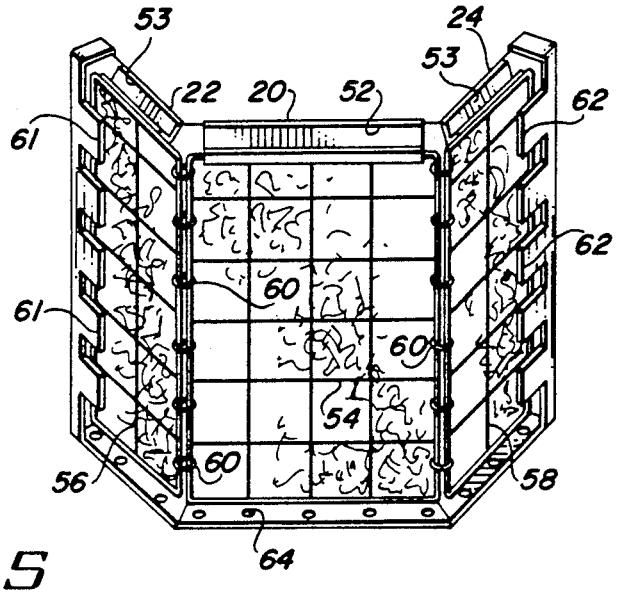
FIG. 5 is a perspective view of a side and wire screen assembly securing the pads to the side.

Referring now to FIG. 5, a perspective view is shown of the cooler pads holding wire structure by which the pads along one side may be emplaced or removed in a single operation. The pad itself is not shown. As can be seen from the structure shown in FIG. 5, two major pieces are utilized. The first major piece is that of the side member, being of a single piece of metal, with its three panels, namely center or front panel 20, and left and right panels 24 and 22 respectively. The second major piece is opposite each panel of the side member, namely the wire screen assembly, the wire screen assembly comprising three connected elements, namely front screen 54, right screen 56, and left screen 58. These screens are crossed vertical and horizontal wires connected together at their end vertical wires by spaced apart rings 60, these rings serving to make the three screens a single continuous connected unit and to conform to the side member with its angled panels. The screen assembly is held next to the side member by means of tabs 61 and 62 which are connected to the outside ends of the cupped-around portions of the right and left panel. Each end of each tab has a folded over hook to catch the outside vertical wire member of the left and right screens 58 and 56 respectively.

At the very top of FIG. 5 are three troughs, namely center or front trough 52, left trough 53, and right trough 55. As mentioned earlier, each of the troughs overhang one portion of each pad, the troughs receiving water from the spider legs shown in FIG. 4. Each of the troughs are individually attached to the respective front, right or left panels of the side member. When the pad is inserted into the cooler pad holding structure made up of the side member and the wire screen assembly shown in FIG. 5, the thickness of the pad requires that the pad push back on the wire screen assembly such that the turned down hooks of tabs 61 and 62 are able to secure inside the wire screen against the vertical end wire of each of those wire screens. At the very bottom of the cooler side member is a bottom lip through which are a series of openings 64 which assure that water percolating through each of the pads will enter the reservoir at the bottom of the cooler. As indicated in the discussion in connection with FIG. 4, in most cases the water level is above the bottom of the pads and so the openings 64 may not be necessary in all coolers. Additionally, the folded over bottom lip portion of the side member in which the openings are formed lead back into the interior at the bottom of the evaporative cooler.

Figure 6:
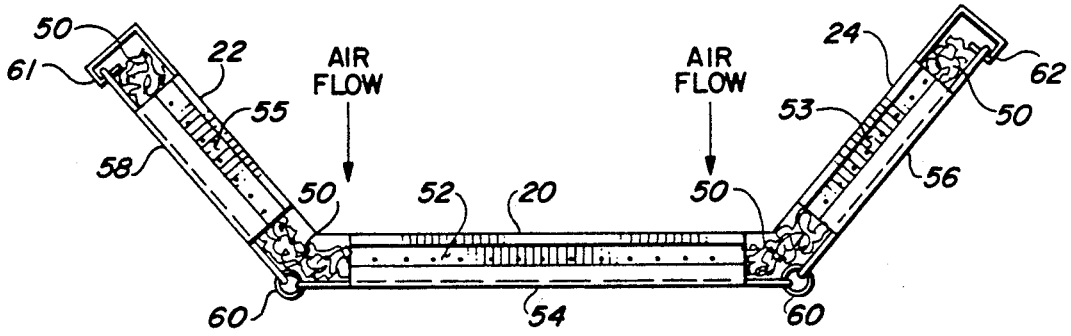
FIG. 6 is a top view of a side of the evaporative cooler together with the pad and screen assembly securing the pad to the side.

FIG. 6 is a top view of the two piece cooler pad holding structure shown in FIG. 5. As shown by the arrows, air flows into the panels of each side member and through the lower openings of each of the three panels, namely front panel 20, right panel 22 and left panel 24. On the opposite side of the side member shown in FIG. 6 are the separate wire screens which are joined by the plurality of rings, i.e., left screen 58, center or front screen 54 and right screen 56. Also shown are the three troughs, namely front trough 52, right trough 55 and left trough 53. Shown in each of the troughs are the openings which allow water to drip out of the troughs, these openings consisting of slits. At the very outside ends of left and right panels 24 and 22 respectively are tabs 61 and 62 with their bent inward hooks surrounding the vertical end wire member of each of the wire screens. Urging each of the wire screens outward in order that the hooked-over portion of the end screens may be firmly held is the centrally contained pad 50, in the preferred embodiment one pad running the whole length of the side member. Lastly, rings 60 attaching the left and right screens to the center screen are also shown. Each of the wire screens conform generally in width to the width of the respective panel they face, although each will be a little bit wider.

Figure 7:
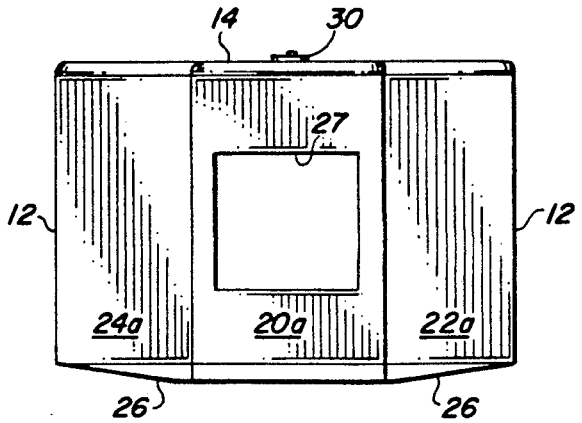
FIG. 7 is a front elevation view of a side-draft evaporative cooler employing the invention.

Lastly, FIG. 7 shows a front elevational view of the alternate embodiment of the invention wherein the invention has been incorporated into a side-draft cooler. More specifically, shown is one of the four sides of the usual cube shaped cooler similar to that view shown in FIG. 2, however, the side shown containing the output duct or conduit 27. Since the output duct takes up such a substantial portion of the center panel 20*a*, the center panel is not louvered nor are there water receiving pads behind it. Similarly, the right and left panels 22*a* and 24*a* respectively are not louvered either but merely consists of flat metal panels. However, it is obvious that these two panels could have louver openings with wetted pads behind the openings. In most cases, that one side containing the output duct is secured to the frame of the evaporative cooler, in the preferred embodiment, bottom 26 and each of the projection ends 12. Here again the top cover 14 may or may not be removable.

In construction of the preferred embodiment and the alternate embodiment, sheet metal may be used, such as galvanized iron, or aluminum. In addition, as of late, it has become quite common for major components of the evaporative cooler to be constructed from a durable plastic or fiberglass, those elements consisting generally of the top and bottom as well as the four sides. In the subject case, it would also include the corner projections.

While a preferred embodiment of the invention, together with an alternate embodiment, has been shown and described, it is appreciated that other such embodiments of the invention are possible and that there is no intent to limit the invention by such disclosure, but rather it is intended to cover all modifications and alternate embodiments falling within the spirit and the scope of the invention as defined in the appended claims.

I claim:

1. An improvement in efficiency of an evaporative cooler of four sides joined at four corners, a top, and a bottom, adapted to pull in outside environment air interiorly through a plurality of louver openings in the sides therein, the air then passing through wetted pads behind the louvered openings to evaporative water and to be thereby cooled, the cooled air ejected from the cooler interior through a duct connecting with the cooler interior, the improvement comprising:

means modifying a side of the evaporative cooler, said modified side having added louver openings therein and wetted pads therebehind, said means including at least one outwardly protruding projection, said projection situated at one corner of two joined sides and having added louvered openings therein and wetted pads therebehind whereby the volume of air pulled into the evaporative cooler interior is increased and the efficiency is improved.

2. The improvement in evaporative cooler efficiency as defined in claim 1 wherein said means modifying a side to add louver openings therein and wetted pads therebehind includes a plurality of four outwardly protruding projections, one of each at the four corners of the evaporative cooler, each of said projections having two spaced apart oppositely situated panels and an interposed end, each of said panels having a plurality of louvered openings therein with wetted pads therebehind to permit the passage of air therethrough and into the cooler interior.

3. The improvement in evaporative cooler efficiency as defined in claim 2 wherein each said modified side of the evaporative cooler comprises a front panel having two sides and a pair of angled panels, one each of said angled panels situated on opposite sides of said front panel, each one of said pair of angled panels comprising one of two outwardly protruding projections panels situated at adjacent corners of the evaporative cooler, said front panel and said adjacent projections panels joined together unbroken to comprise said modified side of the evaporative cooler.

4. The improvement in evaporative cooler efficiency as defined in claim 3 wherein each said modified side of the evaporative cooler is situated on four sides of the evaporative cooler.

5. The improvement in evaporative cooler efficiency as defined in claim 4 further including a wire structure assembly operably attached to said modified side of the evaporative cooler, said wire structure assembly comprising a front portion and two oppositely situtated side portions adapted to secure the wetted pads to said modified side.

6. The improvement in evaporative cooler efficiency as defined in claim 5 wherein said wire structure assembly center portion is operably attached to each of said two oppositely situated side portions.

7. The improvement in evaporative cooler efficiency as defined in claim 6 wherein said wire structure assembly center portion and each said side portions comprise a plurality of over-lapping vertical and horizontal wires connected at their points of over-lapping, all said portions having two vertical wires defining the ends of each said portions.

8. The improvement in evaporative cooler efficiency as defined in claim 7 wherein said wire structure assembly two side portions are rotatably secured to opposite ends of said wire structure assembly central portion by a plurality of rings, said rings encompassing each of said vertical wires of said side portions ends and said opposite ends of said central portion.

9. The improvement in evaporative cooler efficiency as defined in claim 8 wherein said angled panels of each said modified side of the evaporative cooler includes a cupped around hook, said cupped around hook adapted to secure said vertical end wires of each of said wire structure assembly side portions to secure said wire structure assembly to said modified side.

10. The improvement in evaporative cooler efficiency as defined in claim 1 wherein said means modifying a side to add louver openings therein and wetted pads therebehind includes a plurality of four outwardly protruding projections, one of each at the four corners of the evaporative cooler, each of said projections having two spaced apart oppositely situated panels and an interposed end.

11. The improvement in evaporative cooler efficiency as defined in claim 10 wherein each of said modified sides of the evaporative cooler comprises a front panel having two sides and a pair of angled panels, one each of said angled panels situated on opposite sides of said front panel, each one of said pair of angled panels comprising one of two outwardly protruding projections panels situated at adjacent corners of the evaporative cooler, said front panel and said adjacent projections panels joined together unbroken to comprise said modified side of the evaporative cooler.

12. The improvement in evaporative cooler efficiency as defined in claim 11 wherein each said modified side of the evaporative cooler is situated on three sides of the evaporative cooler, the forth side having the duct therethrough connecting with the cooler interior.

13. The improvement in evaporative cooler efficiency as defined in claim 12 wherein each said modified side of the evaporative cooler front panel and each one of said pair of angled panels have a plurality of louvered openings therein with wetted pads therebehind to permit the passage of air therethrough and into the cooler interior.

14. The improvement in evaporative cooler efficiency as defined in claim 13 further including a wire structure assembly operably attached to each said modified side of each of the three sides of the evaporative cooler, said wire structure assembly comprising a front portion and two oppositely situated side portions adapted to secure the wetted pads to said modified side.

15. The improvement in evaporative cooler efficiency as defined in claim 14 wherein said wire structure assembly center portion is operably attached to each of said two oppositely situated side portions.

16. The improvement in evaporative cooler efficiency as defined in claim 15 wherein said wire structure assembly center portion and each said side portions comprise a plurality of over-lapping vertical and horizontal wires connected at their points of over-lapping, all said portions having two vertical wires defining the ends of each said portions.

17. The improvement in evaporative cooler efficiency as defined in claim 16 wherein said wire structure assembly two side portions are rotatably secured to opposite ends of said wire structure assembly central portion by a plurality of rings, said rings encompassing each of said vertical wires of said side portions ends and said opposite ends of said central portions.

18. The improvement in evaporative cooler efficiency as defined in claim 17 wherein said angled panels of each said modified side of the evaporative cooler includes a cupped around hook, said cupped around hook adapted to secure said vertical end wires of each of said wire structure assembly side portions to secure the wetted pads interposed said wire structure assembly and said modified side.

* * * * *